United States Patent [19]

Petrini

[11] 4,232,412

[45] Nov. 11, 1980

[54] PATIENT TRANSFER DEVICE

[76] Inventor: Bartholomew Petrini, 7517 N. Ridge Dr., Omaha, Nebr. 68112

[21] Appl. No.: 964,831

[22] Filed: Nov. 30, 1978

[51] Int. Cl.[2] ..... A61G 1/02

[52] U.S. Cl. ..... 5/86; 5/89

[58] Field of Search ..... 5/81 R, 82 R, 86–89

[56] References Cited

U.S. PATENT DOCUMENTS

| | | | |
|---|---|---|---|
| 1,878,785 | 9/1932 | Leavitt | 5/89 |
| 3,694,829 | 10/1972 | Bakker | 5/81 R |
| 3,914,808 | 10/1975 | Woods | 5/86 |
| 3,940,808 | 3/1976 | Petrini | 5/86 |
| 4,070,721 | 1/1978 | Stasko | 5/89 |

*Primary Examiner*—Casmir A. Nunberg

[57] ABSTRACT

A device for supporting a patient on a lift apparatus includes a generally rigid seat portion foldably conneeted to the lower end of a generally rigid back portion. A main support yoke has an upper cross bar adapted for connection to a lift apparatus and a pair of depending yoke arms connectable to the back portion at a medial position thereon. A pair of dual arm hangers are pivotally suspended from the upper cross bar for supporting opposite sides of the seat portion. Both the yoke arms and hangers may be rigid members which are length adjustable to retracted positions for transferring a patient into confined quarters such as an automobile. Whereas the device is connectable to a lift apparatus by a single connection to facilitate lifting and lowering of a patient, a pair of stabilizer bars are provided for securing the device during transport.

10 Claims, 11 Drawing Figures

PATIENT TRANSFER DEVICE

BACKGROUND OF THE INVENTION

This invention relates generally to patient transfer devices and more particularly to a chair-like structure adapted for supporting non-ambulatory patients on a lift apparatus.

Non-ambulatory patients have generally been confined to an existence of limited movement because of the difficulty of lifting and transporting such patients. These patients can feel free to enjoy an active life-style only if a device is provided in which the patient can be lifted and transported in a comfortable and dignified manner and with little effort on the part of the assistant operating the lift apparatus.

A limited selection of patient transfer devices are presently available. A common type of such devices employs a canvas or fabric sling adapted to be supported by chains, straps or the like from a lift apparatus. But such devices tend to uncomfortably compress the patient's buttocks and/or back and substantially restrict bending movement of the patient's waist when seated on the device.

Another commercially available patient transfer device is disclosed in U.S. Pat. No. 3,940,808 issued on Mar. 2, 1976, the present invention being an improvement of that device. Although the rigid back and seat portions of that device provide very comfortable and unrestricted support for the patient, the multiple connection of that device to the lift apparatus may be a problem for maneuvers in which it is desirable to rotate the patient relative to the lift apparatus.

Accordingly, a primary object of the present invention is to provide an improved patient transfer device.

A further object is to provide a patient transfer device in which a patient may be lifted and transported in a comfortable and dignified manner.

A related object is to provide a patient transfer device which includes generally rigid seat and back portions.

A further object is to provide a patient transfer device which is adaptable for any of various available lift apparatus.

A corresponding object is to provide a patient transfer device adapted to be supported by a single connection to the lift apparatus.

A further object is to provide a patient transfer device having length adjustable support members to facilitate the transfer of a patient into small quarters such as an automobile.

A still further object of the invention is to provide a patient transfer device including means for stabilizing the device relative to a lift apparatus during transport.

Finally, a further object is to provide a patient transfer device which is refined in appearance, durable in use and efficient in operation.

SUMMARY OF THE INVENTION

The patient transfer device of the present invention includes a generally rigid seat portion foldably connected to the lower end of a generally rigid back portion. A main support yoke has an upper cross member adapted for connection to the lift apparatus and a pair of depending yoke arms connectable to a medial portion of the back portion. A pair of dual arm hangers are pivotally suspended from the upper cross member for supporting opposite sides of the seat portion. Accordingly, the back and seat portions are supported in generally stable inclined relation so that a patient supported thereon is neither compressed nor restricted against bending movement at the waist.

Since the entire device is supported by the single swivel connection on the yoke cross bar, it is readily adaptable for use with any of various available lift apparatus. The generally rigid and length adjustable hangers and yoke arms can be extended to provide ample clearance for the patient during normal transport and retracted for transferring the patient into tight quarters such as an automobile. Whereas the single swivel connection enables maximum freedom of movement during raising and lowering of the patient, stabilizer bars are provided for connection to the lift apparatus to assure a safe secure feeling for the patient during transport.

DESCRIPTION OF THE PREFERRED EMBODIMENT

Figures 1, 2, 3, 4, 5, 6:
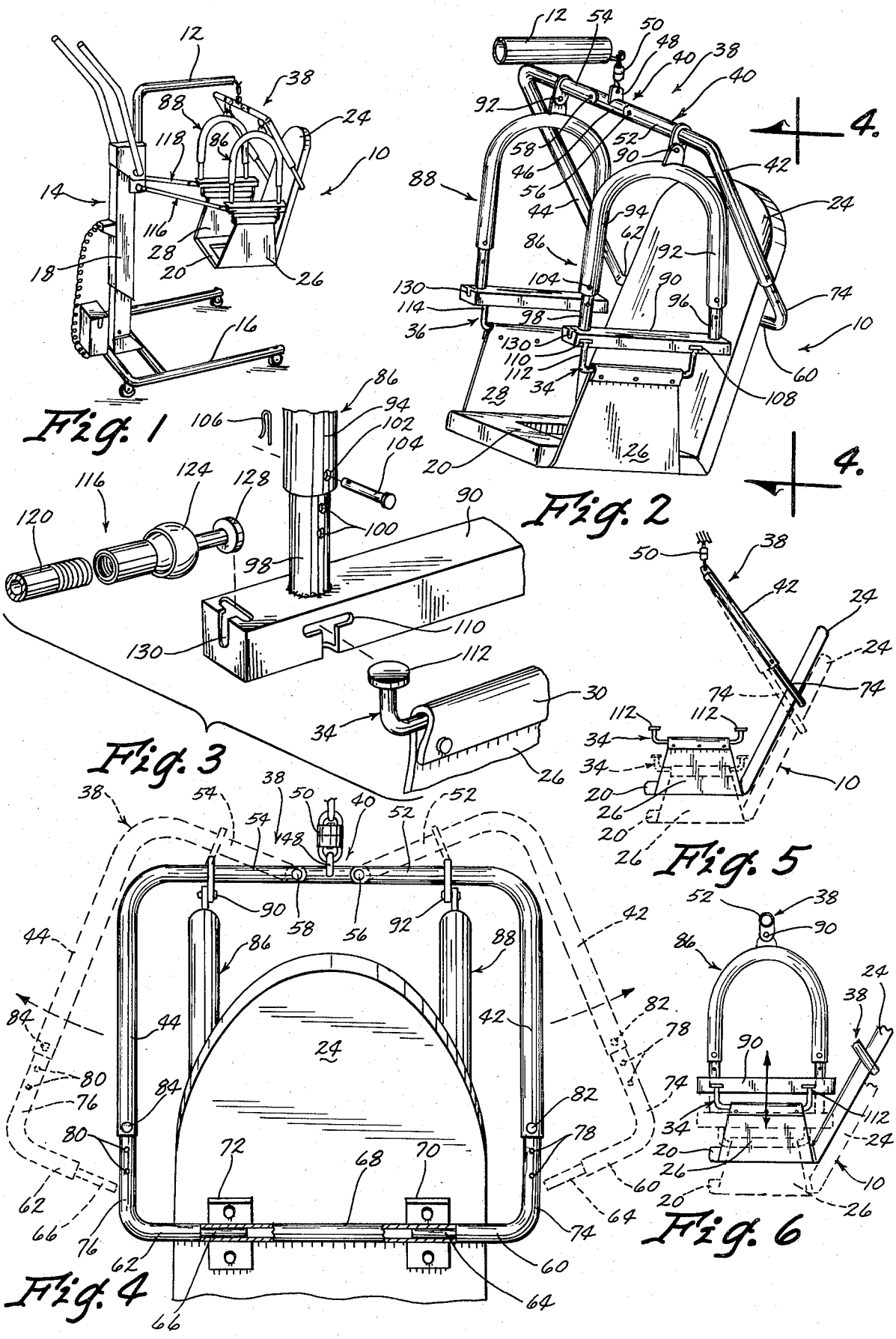
FIG. 1 is a perspective view of the patient transfer device supported on a lift apparatus with the stabilizer bars secured thereto.
FIG. 2 is an enlarged perspective view of the patient transfer device.
FIG. 3 is an exploded detail perspective view showing the connection of the seat portion and stabilizer bar to a hanger.
FIG. 4 is an enlarged partial rear elevational view of the device showing the pivotally moved positions of the yoke arms.
FIG. 5 is a side elevational view showing the extended and retracted positions of the yoke arms.
FIG. 6 is a side elevational view showing the extended and retracted positions of the hanger arms.

The patient transfer device 10 of the present invention is shown in FIG. 1 fully supported on the main support arm 12 of a lift apparatus 14. The lift apparatus includes a caster wheel supported base 16 and an extensible and retractable vertical post 18 supported on the base for raising and lowering the main support arm 12. Lift apparatus 14, which is conventional and commercially available, is illustrated only to show the patient transfer device 10 supported on a lift apparatus.

Referring to FIG. 2, the patient transfer device 10 includes a generally rigid seat portion 20 foldably connected as at 22 to the lower end of a generally rigid back portion 24. Seat portion 20 further includes a pair of flexible side flaps 26 and 28 extended outwardly from opposite sides thereof. The outer ends of the side flaps are secured in folded over relation to provide respective sleeves 30 and 32 for retaining respective coupling bars 34 and 36.

To support the seat and back portions 20 and 24 on the lift apparatus 14, there is provided a main support yoke, indicated generally at 38, which includes an upper cross bar 40 and a pair of yoke arms 42 and 44 extended downwardly from opposite ends of the cross bar 40. It can be seen that the upper cross bar 40 includes a center portion 46 having an upstanding flange 48 secured thereon for connection to the lift apparatus by a swivel connector 50. Cross bar 40 further includes a pair of oppositely directed end portions 52 and 54 which are connected to the center portion 46 for pivotal movement about generally horizontal axes as indicated at 56 and 58 in FIGS. 2 and 4.

To pivotally connect the yoke arms 42 and 44 to back portion 24, the yoke arms terminate in inwardly extended portions 60 and 62 which include smaller diameter extensions 64 and 66 adapted to be received within opposite ends of a socket 68 which is secured on the back side of back portion 24 by brackets 70 and 72. The inwardly extended portions 60 and 62 form the lower leg of a pair of L-shaped tubular members 74 and 76 which are telescopically received within the respective yoke arms 42 and 44. The L-shaped members are provided with vertically spaced holes 78 and 80 which are alignable with a hole (not shown) through the corresponding yoke arm for securement by pins 82 and 84 at selected vertical positions for a purpose to be described below.

To support the seat portion 20 on the upper cross bar, a pair of dual arm hangers 86 and 88 are suspended from the end portions 52 and 54 of cross bar 40 for pivotal movement about generally horizontal axes as indicated at 90 and 92. Each dual arm hanger 86 and 88 includes a generally rigid and horizontally disposed seat support bar 90 at the lower end thereof and a pair of hanger arms 92 and 94 which have respective lower ends 96 and 98 connected to the seat support bar 90 at spaced apart positions and upper ends operatively connected to cross bar 40 by the pivotal connections at 90 or 92. As can be clearly seen in FIGS. 3 and 6, lower ends 96 and 98 are generally rigid tubular members fixed onto the seat support bar 90 in perpendicular relation at longitudinally spaced apart positions. The hanger arms 92 and 94 together have an inverted U-shaped configuration whereby the hanger arms are disposed in parallel relation and spaced apart for telescopically receiving the lower ends 96 and 98 therein. Vertically spaced holes 100 as indicated in FIG. 3 are provided in the lower ends for alignment with a hole 102 through the corresponding hanger arm for securement of the lower ends to the hanger arms at selected vertical positions by a lock pin 104 and cotter key 106 or any other suitable means.

It can be seen in FIGS. 2 and 3 that the seat support bar 90 has a pair of T-shaped slots 108 and 110 formed therein at longitudinally spaced apart positions for laterally receiving the generally T-shaped opposite ends 112 and 114 of the side flap coupling bars 34 or 36. Accordingly, it is seen that the dual arm hangers 86 and 88 serve to pivotally support opposite sides of the seat portion 20 from the upper cross bar 40.

Referring to FIG. 4, it can be seen that each cross bar end portion 52 and 54 forms part of a generally rigid C-shaped member including its associated yoke arm 42 or 44 and inwardly extended portions 60 or 62. It can be seen that each C-shaped member is pivotally movable as a unit. Accordingly, the load of a patient or of even the device itself which is transmitted to the end portions 52 and 54 of the cross bar through the hangers and yoke arms urges the C-shaped members to pivot downwardly and bias the inwardly extended portions 60 and 62 into the socket 68 on the back portion 24.

Vertical adjustment of the yoke arms 42 and 44 and dual arm hangers 86 and 88 is provided as described above in order to facilitate the maneuvering of the device and a patient thereon into confined quarters such as an automobile. Accordingly, referring to FIGS. 5 and 6, it can be seen that the yoke arms and dual arm hangers are adjustably movable between the normal extended dotted line positions and the retracted solid line positions. In the extended positions, a patient's head is supported at a position in ample clearance relation from the yoke cross bar 40 whereas in the retracted solid line positions, the patient's head is supported substantially level with the cross bar 40 for a more vertically compact arrangement.

Figure 7:
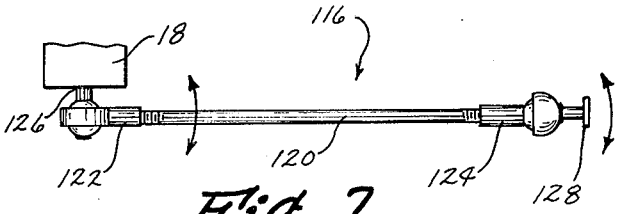
FIG. 7 is a top plan view of a stabilizer bar of the invention.

As thus far described, the only connection between the device 10 and the lift apparatus 14 is the swivel connector 50 on the cross bar 40. This connection enables any desired pivotal or rotational movement of the chair relative to the main support arm 12 as the patient is being raised or lowered. During transport, however, it is desirable to stabilize the device 10 relative to the lift apparatus 14 so that the patient will feel safe and secure. For this purpose, there is provided a pair of stabilizer bars 116 and 118 (FIG. 1) which are connected at one end to the lift apparatus 14 and at the other end to the seat support bars 90. In FIG. 7, it can be seen that each stabilizer bar consists of an elongated rod 120 having opposite threaded ends for connection to the female ends of a pair of universal Heim bearings 122 and 124. Each of these bearings permits both vertical and horizontal pivotal movement between the opposite ends thereof. Bearing 122 is adapted to be secured to post 18 of the lift apparatus 14 as indicated at 126 and bearing 124 is provided with a generally T-shaped connector extended outwardly therefrom for receipt within a corresponding T-shaped slot through the upper surface of the forward end of the seat support bar 90 as shown best in FIG. 3. Accordingly, the stabilizer bars 116 and 118 secure the device 10 against fore and aft swinging movement relative to the lift apparatus 14 as well as rotational swivel movement.

Figure 8:
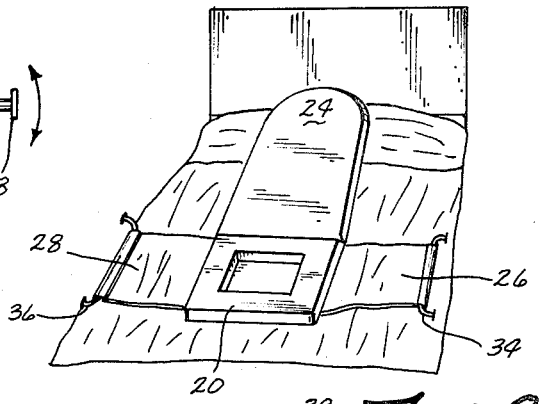
FIG. 8 is a perspective view of the seat and back portions of the invention positioned on a patient bed.
Figure 9:
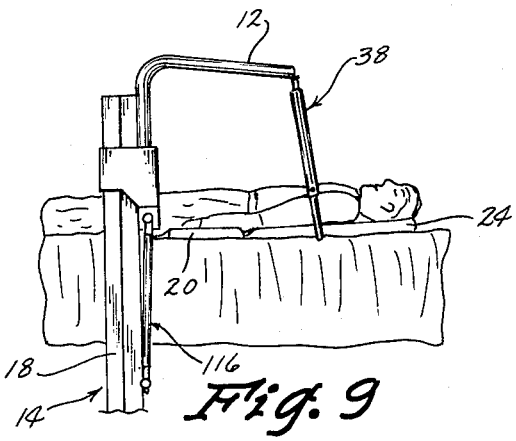
FIG. 9 is a side elevational view showing a patient supported on the seat and back portions.

In operation, the seat and back portions 20 and 24 are detached as a unit from the yoke arms and hangers for placement on a patient's bed as shown in FIG. 8. If a patient is positioned on the bed, placement of the back and seat portions thereon can be accomplished by simply rolling the patient onto his side, moving the seat and back portions into position against the patient and then rolling the patient back into a prone position on the seat and back portions as indicated in FIG. 9. In order to lift the patient, it is then an easy matter to connect the cross bar 40 of the device to a lift apparatus 14 which may then rolled to a position adjacent the patient. The yoke arms 42 and 44 are then pivoted outwardly and arranged on opposite sides of the back portion 24 for insertion of the inwardly extended portions 60 and 62 into the socket 68 on the underside of back portion 24. At this point, the dual arm hangers 86 and 88 are suspended above the patient and it is an easy matter to insert the T-shaped ends 112 and 114 of the seat flap coupling bars 34 and 36 into the T-shaped slots 108 and 110 of the seat support bars 90. Accordingly, connection of the device 10 to the lift apparatus 14 is completed whereupon an operator may begin to lift the patient.

Figure 10:
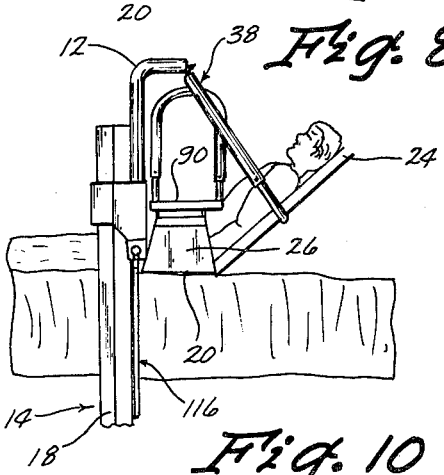
FIG. 10 is a side elevational view, similar to FIG. 9, showing the back portion partially elevated.
Figure 11:
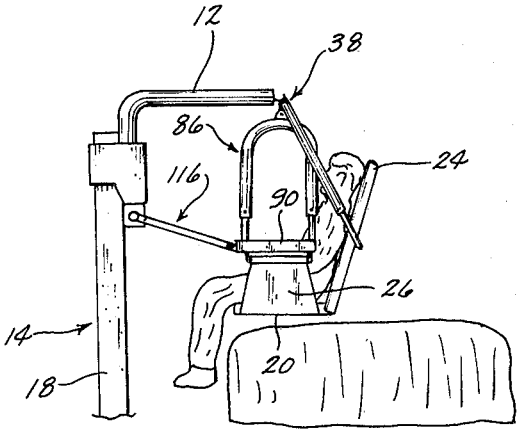
FIG. 11 is a side elevational view showing the patient and device fully supported on a lift apparatus.

As the lift apparatus 14 is raised, it can be seen in FIG. 10 that initially back portion 24 is folded upwardly to bring the patient to a sitting position. Seat portion 20 remains stationary on the bed due to the weight of the patient. It will be understood that during this initial stage of the lifting, the wheeled base 16 of the lift apparatus enables movement of the lift apparatus 14 to center itself above the patient and device 10. Once the patient reaches a sitting position, further lifting movement of the lift apparatus raises the seat and back portions 20 and 24 in unison clear of the bed as indicated in FIG. 11. Upon attachment of the stabilizer bars 116 and 118, the patient may be safely moved to any desired location. Lowering of the patient is accomplished by simply reversing the above procedure accept that if the patient is lowered into a wheelchair or the like, it is understood that the back portion 24 will remain in an upright position.

If it is intended to move the patient into a confined area such as an automobile seat, the procedure for lifting the patient is the same as described above except that the yoke arms 42 and 44 and dual arm hangers 86 and 88 are first retracted to the solid line positions therefor as shown in FIGS. 5 and 6 before securement to the seat and back portions.

Thus there has been shown and described a patient transfer device which accomplishes at least all of the stated objects.

I claim:

1. A device for supporting a patient on a lift apparatus comprising, a generally rigid back portion, a generally rigid seat portion foldably connected to a lower end of said back portion, a main support yoke including an upper cross bar, and a pair of yoke arms extended downwardly from opposite ends of said cross bar, means for supporting said cross bar on said lift apparatus, means for pivotally connecting lower ends of said yoke arms to said back portion at a medial position thereon, a pair of dual arm hangers pivotally connected to said cross bar and extended downwardly therefrom, and means for securing lower ends of said dual arm hangers to opposite sides of said seat portion.

2. The device of claim 1 wherein a dual arm hanger includes an elongated generally rigid seat support bar at the lower end thereof and a pair of hanger arms, said hanger arms having upper ends operatively connected to said cross bar and lower ends connected to said seat support bar at spaced apart positions thereon.

3. The device of claim 2 wherein said hanger arms are generally rigid.

4. The device of claim 3 wherein said hanger arms are length adjustable.

5. The device of claim 4 wherein said pair of hanger arms together have an inverted U-shaped configuration.

6. The device of claim 4 wherein said yoke arms are length adjustable.

7. The device of claim 2 further comprising a pair of stabilizer bars, means for connecting one end of said stabilizer bars to said seat support bars, and means on the other ends of said stabilizer bars for connection to said lift apparatus.

8. A device for supporting a patient on a lift apparatus comprising, a generally rigid back portion, a generally rigid seat portion foldably connected to a lower end of said back portion, a main support yoke including an upper cross bar, and a pair of yoke arms extended downwardly from opposite ends of said cross bar, means for supporting said cross bar on said lift apparatus, means for pivotally connecting lower ends of said yoke arms to said back portion at a medial position thereon, a pair of dual arm hangers pivotally connected to said cross bar and extended downwardly therefrom, and means for securing lower ends of said dual arm hangers to opposite sides of said seat portion, a dual arm hanger including an elongated generally rigid seat support bar at the lower end thereof and a pair of hanger arms, said hanger arms having upper ends operatively connected to said cross bar and lower ends connected to said seat support bar at spaced apart positions thereon, said seat portion including a pair of flexible side flaps extended outwardly from opposite sides thereof, each side flap including a generally rigid coupling adapted for releasable connection to said seat support bar at spaced-apart positions thereon.

9. A device for supporting a patient on a lift apparatus comprising, a generally rigid back portion, a generally rigid seat portion foldably connected to a lower end of said back portion, a main support yoke including an upper cross bar, and a pair of yoke arms extended downwardly from opposite ends of said cross bar, means for supporting said cross bar on said lift apparatus, means for pivotally connecting lower ends of said yoke arms to said back portion at a medial position thereon, a pair of dual arm hangers pivotally connected to said cross bar and extended downwardly therefrom, and means for securing lower ends of said dual arm hangers to opposite sides of said seat portion, said yoke arms being generally rigid and terminating at the lower ends thereof in inwardly extended portions, said back portion including socket means secured thereto at said medial position for receiving said inwardly extended portions.

10. The device of claim 9 wherein said cross member includes a center portion adapted for connection to said lift apparatus, and a pair of oppositely directed end portions pivotally connected to said center portion, said dual arm hangers and yoke arms being connected to said end portions, and each end portion and the associated yoke arm and inwardly extended portion comprising a generally rigid C-shaped member pivotally movable as a unit whereby any load on said hanger and yoke arm biases said inwardly extended portion into said socket means.

* * * * *